United States Patent [19]

Clark

[11] 4,185,283

[45] Jan. 22, 1980

[54] MULTIPLE CHARACTER WORD INDICATION SYSTEM EMPLOYING SEQUENTIAL SENSIBLE INDICIA

[76] Inventor: Lloyd D. Clark, 15 Conrad St., San Francisco, Calif. 94131

[21] Appl. No.: 867,772

[22] Filed: Jan. 9, 1978

[51] Int. Cl.[2] ..... G04C 21/12

[52] U.S. Cl. ..... 340/802; 58/38 R; 58/57.5; 340/706; 340/384 E; 340/407

[58] Field of Search ..... 340/407, 384 E, 802; 58/23 R, 38 R, 12, 13, 57.5

[56] References Cited

U.S. PATENT DOCUMENTS

| | | | |
|---|---|---|---|
| 494,727 | 4/1893 | Audemars et al. . | |
| 560,926 | 5/1896 | Prahl . | |
| 3,664,116 | 5/1972 | Emerson et al. | 58/38 R |
| 3,925,777 | 12/1975 | Clark | 340/336 |
| 3,946,549 | 3/1976 | Cake | 58/38 R |
| 4,055,843 | 10/1977 | Whitaker | 340/384 E |
| 4,073,133 | 2/1978 | Earls et al. | 340/384 E |
| 4,074,516 | 2/1978 | Kondo | 58/38 R |
| 4,078,376 | 3/1978 | Freeman | 58/38 R |
| 4,095,410 | 6/1978 | Kaneko | 58/38 R |

*Primary Examiner*—David L. Trafton
*Attorney, Agent, or Firm*—David Pressman

[57] ABSTRACT

A multiple-character-word indication system employs a humanly sensible output in which plural associated characters which constitute a word representing time, temperature, or other information are indicated sequentially through the use of sensible (audible, palpable, visible) indicia in coded form. The words are generated in electronic form by known means. Individual characters are sequentially selected and then supplied to electronic circuitry which generates a code of sequential signals corresponding to the character. This code is then applied to one or more transducers which convert the signals to the sensible indicia. The output indication can be initiated either periodically or upon demand. The readout transducer preferably produces plural types of sensible sensations, such as tones of different pitch, to distinguish the respective characters of the word. In a preferred embodiment the system is a clock which indicates different digits of the time of day by sequential coded tones.

21 Claims, 1 Drawing Figure

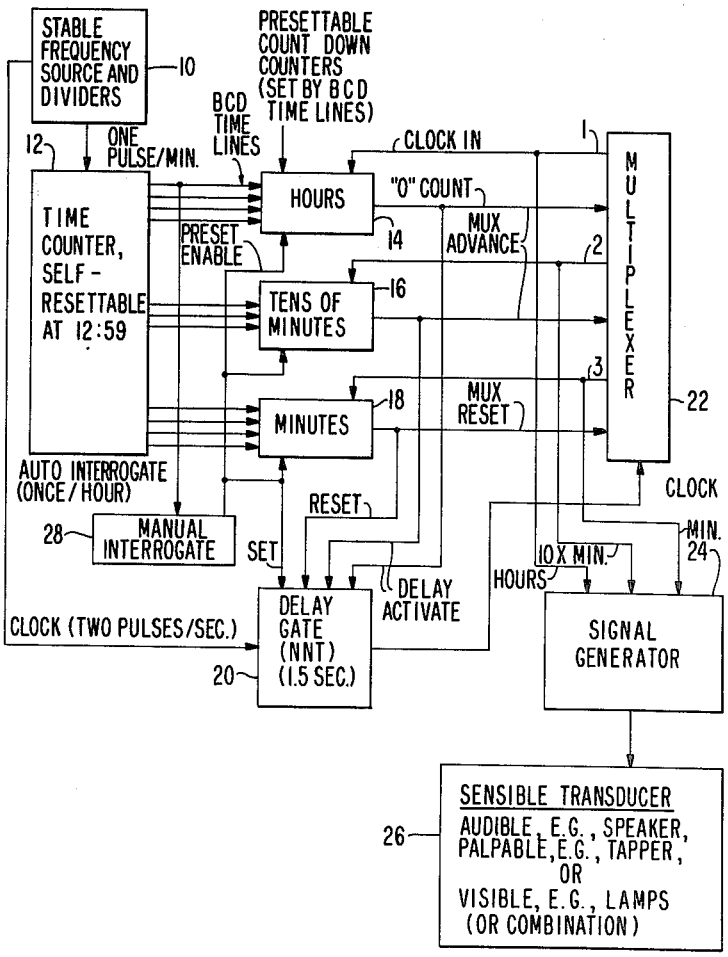

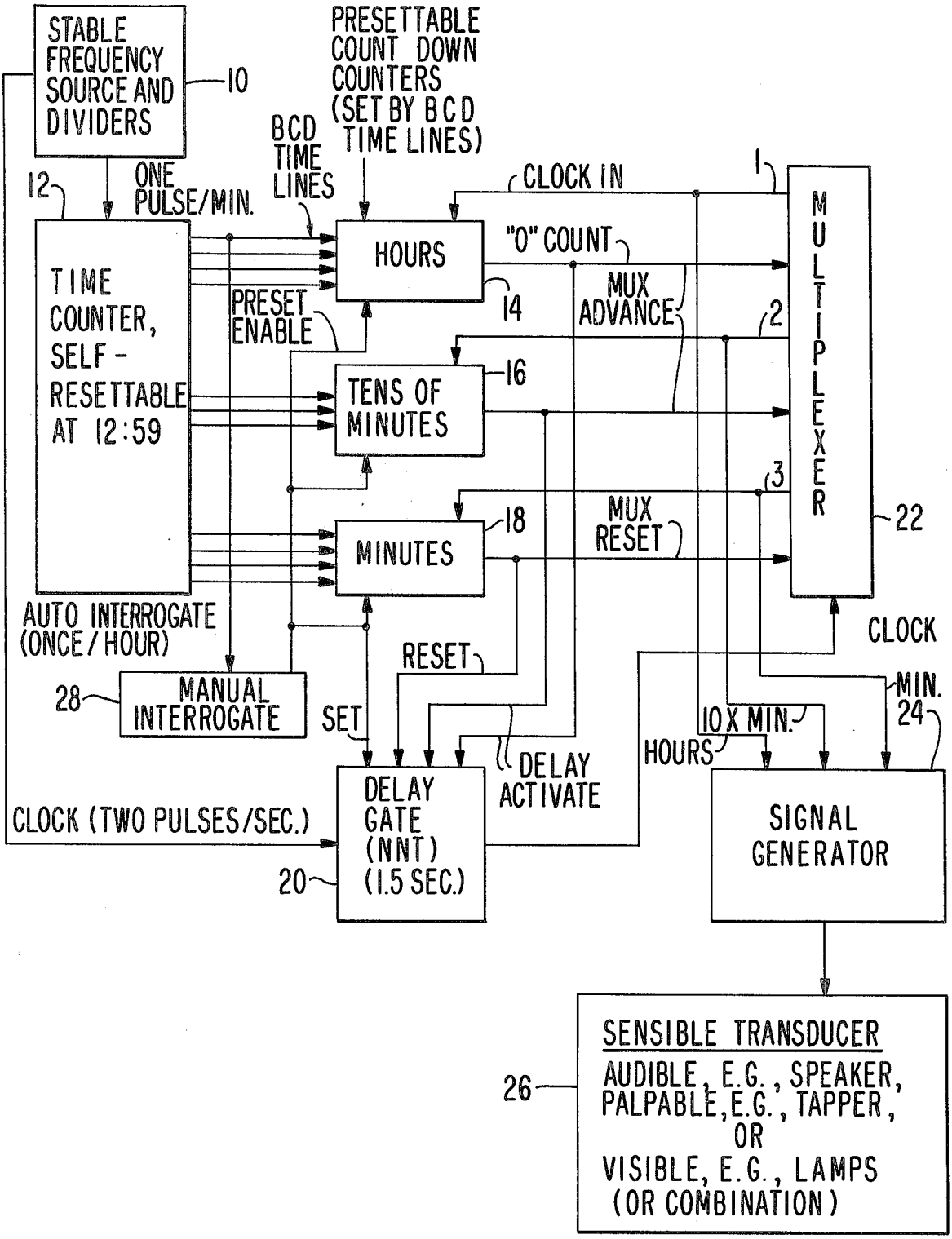
STABLE FREQUENCY SOURCE AND DIVIDERS
10
PRESETTABLE COUNT DOWN COUNTERS (SET BY BCD TIME LINES)
BCD TIME LINES
12
ONE PULSE/MIN.
CLOCK IN
1
MULTIPLEXER
TIME COUNTER, SELF-RESETTABLE AT 12:59
HOURS
"0" COUNT
14
MUX ADVANCE
PRESET ENABLE
2
TENS OF MINUTES
16
3
MINUTES
18
MUX RESET
22
AUTO INTERROGATE (ONCE/HOUR)
CLOCK
RESET
MIN.
24
28
MANUAL INTERROGATE
SET
10X MIN.
HOURS
DELAY ACTIVATE
DELAY GATE (NNT) (1.5 SEC.)
CLOCK (TWO PULSES/SEC.)
20
SIGNAL GENERATOR
SENSIBLE TRANSDUCER
AUDIBLE, E.G., SPEAKER, PALPABLE, E.G., TAPPER, OR VISIBLE, E.G., LAMPS (OR COMBINATION)
26

MULTIPLE CHARACTER WORD INDICATION SYSTEM EMPLOYING SEQUENTIAL SENSIBLE INDICIA

BACKGROUND

1. Field of the Invention

This invention relates to an information indicating system in which plural-character words can be represented by a humanly-sensible code of sequential indicia, such as a series of tones.

2. Prior Art

Sequential sensible readouts have been used in various fields. For example in horology, coded sequential audible indicia (sounds) have been periodically made by chiming clocks, grandfather's clocks, ship bell clocks, cuckoo clocks, alarm clocks, etc. Non-sequential audible indicators also have been used to indicate that a certain stage in a process has been achieved, such as a sound that indicates when a prescribed period of time has passed, a temperature has been reached, etc.

However no audible indicators were available to indicate precise information, such as, in horology, the exact time during the period between quarter-hour intervals. The other audible indicators gave indications only at specific stages in the process being monitored. Using these conventional audio indicators, it was not possible to know, for example, the temperature of an oven before the alarm point was reached. Similarly, a device for sounding an alarm after a period of time has elapsed (a kitchen timer, for example) could not indicate the time prior to the end of the set time period.

Accordingly it is one object of my invention to provide a sensible indicator which can provide far more precise and complete information about a process or changing data.

In may earlier U.S. Pat. No. 3,925,777 Dec. 9, 1975, there is taught a multiple character word indicating system in which the characters of the word are indicated sequentially at a single section. While this system is desirable and advantageous and provides a more economical readout, or a larger readout, it is not usable by the sightless or by persons with extremely limited version. Also it requires a relatively complex transducer capable of indicating plural characters at a single station.

Accordingly other objects of the present invention are to provide a character indicating system which can be used by the sightless or by persons with extremely limited vision, to provide such a system which requires a far simpler readout device, and to provide an information indicating system which is susceptible of being sensed audibly, palpably or visibly. Further objects and advantages will become apparent from consideration of the ensuing description thereof.

FUNCTION OF THE INVENTION

According to the present invention, a system for indicating plural character words employ a sensible transducer for indicating the word by means of a code of sequential indications for each character of the word. In the preferred embodiment the system is a clock and indicates the time of day at predetermined periodic intervals or upon manual command by emitting a series of groups of tones, each group containing the number of tones equal to the digit represented by the group, with the tones of adjacent groups having different pitches for readily distinguishing the different digits of the time.

For example in a two-tone system, the time 2:34 would be indicated by the following tones: A, A; B, B, B; A, A, A, A; where A and B are tones of different pitches, the commas represent short intervals, and the semicolons represent longer intervals.

In a three-tone system, the time 2:34 would be indicated by the system producing the following tones; A, A; B, B, B; C, C, C, C; were C is a tone of a third pitch.

DESCRIPTION

The system shown in the drawing provides one preferred system for accomplishing the foregoing and other functions with a three-tone system, but which is readily adaptable to a two-tone system.

Stable Frequency Source and Dividers 10 and Self-resettable Time Counter 12 are both well known in the art; they are found in most electronic timepieces and are discussed in my aforementioned patent. Briefly, source 10 generates pulses at a high stable frequency, say 32,768 Hz and divides this frequency down to provide two outputs, the left-hand output supplying two clock pulses per second and the bottom output supplying one pulse per minute, both with a 50% duty cycle. Time counter 12 counts the minute pulses in horological fashion and provides a continuous binary coded decimal (BCD) parallel output on the eleven lines leading from the right-hand side of counter 12. Specifically, the bottom four outputs of counter 12 represent minutes, the least significant digit of the time, the middle three outputs represent tens of minutes, and the top four outputs represent hours, the most signficant digit of the time. For example at the time 12:34, the binary outputs of counter 12 would read (from top down) 1100, 011, 0100 in accordance with well known binary representations indicating powers of two. (The tens of minutes output has only three lines since this digit has a maximum value of 6.) As indicated, counter 12 resets at 12:59 and can be manually set to any desired time by well known setting controls (not indicated).

The BCD time lines will set three presettable countdown counters, 14, 16, and 18, provided that the PRESET ENABLE inputs at the bottoms of these counters are activated. When any of these counters is thus set and clock pulses are supplied to its upper input, the counter will provide an output on its right-hand "zero count" lead when it has received its preset number of pulses, i.e., the counter has decremented to zero.

The two-per-second clock pulses supplied by source 10 are applied to a Delay Gate 20 which is normally non-transmissive (NNT), but which will pass the clock pulses through to its right-hand output when its SET input is activated. With either of the two DELAY ACTIVATE inputs of gate 20 are activated, the gate will be rendered non-transmissive for 1.5 seconds (three clock pulses). When the RESET input of gate 20 is activated, gate 20 will be rendered non-transmissive until its set input is once again activated.

After passing through gate 20, the clock pulses are applied to a Multiplexer or distributor 22 which has three outputs, 1, 2, and 3, and which initially supplies the clock pulses at its "1" output to hours counter 14. Upon return of a zero count/multiplex (MUX) advance output from counter 14, multiplexer 22 will advance and will supply the clock pulses at its "2" output to tens of minutes counter 16. Upon return of a MUX advance input from counter 16, multiplexer 22 will then supply the clock pulses at its third output to minutes counter 18. Upon return of a zero count/mux reset from counter 18, multiplexer 22 will be reset and will be arranged to once again supply clock pulses, when received, to its "1" output.

Multiplexer 22 also supplies the clock pulses in sequence to the three inputs of Signal Generator 24, which is arranged to provide three different driving signals at Sensible Transducer 26, which in turn provides a humanly-sensible output. In the preferred embodiment generator 24 provides alternatives audio signals of three different frequencies and sensible transducer 24 may comprise a loudspeaker or other audio transducer.

The system includes a Manual Interrogate control 26, which when actuated, e.g. by a pushbutton or touch sensor, activates the PRESET ENABLE inputs of counters 14, 16, and 18 and also sets delay gate 20, rendering it transmissive. Manual interrogate control 28 is also supplied with an input from the top output of counter 12 which is active once per hour; thus the PRESET ENABLE inputs of counters 14, 16, and 18 and the SET input of delay gate 20 are also activated once per hour automatically.

OPERATION OF PREFERRED EMBODIMENT

The system shown in the drawing operates to provide an audible indication of the time by a series of groups of tones, with each group representing a different digit of the time and having a distinctive pitch, as follows.

In response to the one pulse per minute output of source 10, time counter 12 will provide, at its BCD output lines, a continuous indication of the time in binary form. Assuming that the time is 2:34 and it is desired to interrogate the system to provide an audible indication of the time, manual interrogate control 28 is activated, setting delay gate 20 and also setting counters 14, 16, and 18 with the counts 2, 3, and 4, respectively.

The first (hours) digit of the time (2) will be indicated as follows: The two-per-second pulses supplied from source 10 will pass through gate 20 to multiplexer 22 and then to the input of hours counter 14 and also to the hours input of signal generator 24. Each pulse will cause generator 24 to supply a predetermined first signal, say 600 Hz, which will be applied to transducer 26, so that a 600 Hz tone will be emitted in response to each clock pulse. When two pulses have been supplied to hours counter 14, it will have decremented to zero and its zero-count output will be activated, causing delay gate 20 to be rendered non-transmissive for three counts (1.5 seconds) and switching multiplexer 22 to enable it to supply clock pulses at its "2" output to tens of minutes counter 16.

After the 1.5 second delay has elapsed, the second (tens of minutes) time digit (3) will be indicated. Gate 20 will again become transmissive, supplying clock pulses to counter 16 and the tens of minutes input of signal generator 24, via multiplexer 22. Signal generator 24 will accordingly supply a signal of a second frequency, say 800 Hz, in response to each pulse, and transducer 26 will emit an 800 Hz tone in response to each pulse. When three pulses have been received from multiplexer 22, counter 16 will provide an output, activating the delay in gate 20 to interrupt transmission of pulses and switching multiplexer 22 to supply pulses, when again received, at its "3" output. Thereby transducer 26 will emit three tones at the second (800 Hz) frequency.

After the delay, gate 20 will again become transmissive and the clock pulses will again be conducted, via multiplexer 22, to minutes counter 18 and the minutes input of generator 24. In accordance with the value (4) of the least significant (minutes) digit of the time, transducer 26 will generate four tones, this time of a third frequency, say 1000 Hz, and when counter 18 is decremented to zero, its output will reset gate 20 and multiplexer 22 so that subsequent pulses will again be supplied at its "1" output.

It is thus seen that in response to a command from manual interrogate control 28, transducer 26 has indicated the time (2:34) by providing the following output tones; A, A; B, B, B; C, C, C, C; where A, B, and C represent tones of sequentially higher frequencies, as aforementioned. Thereby a sightless person will be able to determine the time, or the time can be determined in total darkness. It is desirable to have the system cycle automatically on the hour and to this end an automatic interrogate (once per hour) AUTOMATIC INTERROGATE control is provided by connecting the output of the first BCD line from counter 12 to interrogate control 28. If it is also desired to provide a conventional visual display of time, e.g., in LCD or LED form, this can readily be done by connecting appropriate circuitry and a visible readout to the outputs of counter 12 in well known fashion. Such a system facilitates setting of the time, but in practice it has not been found necessary as the time can readily be set by employing only the tones generated by the timepiece.

RAMIFICATIONS

As will be apparent to those skilled in the art, the system described is susceptible of many ramifications and some of these will be briefly described.

In lieu of indicating the hours, tens of minutes, and minutes by the three tone system as described, a two-tone system has been determined to operate satisfactorily and unambiguously. In this system, the hours and minutes tones would be identical and the tens of minutes tone, which separate these two tones, would be different. This embodiment can be realized easily by combining the hours and minutes inputs to generator 24 through an OR gate and providing a two, rather than three, tone generator for unit 24. Table I illustrates how the time 2:34 would be indicated in the two- and three-tone systems, using the symbols already defined.

TABLE I

| Time | 2 | 3 | 4 |
|---|---|---|---|
| Three Tone System | A A | B B B | C C C C |
| Two Tone System | A A | B B B | A A A A |

In lieu of two or three different tones, generator 24 can alternatively be arranged to generate short, medium, and long tones; soft, medium, and loud tones; continuous wave (CW), first modulation (MOD 1), and second modulation (MOD 2) tones; a first CW tone, first and second CW tones, and a second CW tone; and harmonic chords such as a major chord, minor chord, and another chord of CW tones. These possibilities are illustrated by Table II, where A, B, and C (or A repeat) indicate the first, second, and third digits.

TABLE II

| Indication | Tone | | | | |
|---|---|---|---|---|---|
| A | Short | Soft | CW | CW 1 | Major Chord |
| B | Medium | Medium | MOD 1 | CW's 1 and 2 | Minor Chord |
| C (or A repeat) | Long | Loud | MOD 2 | CW 2 | Other Chord |

In lieu of providing audible outputs by means of a loudspeaker, signal generator 24 and transducer 26 can be replaced by preset transducer oscillators which generate tones of preset frequencies in response to DC pulses; one such audio transducer is sold under the trademark SONALERT by the P. R. Mallory Company of Indianapolis, Ind.

As indicated in block 26, in lieu of or in addition to an audible transducer, a palpable transducer can be employed to provide a tactile sensation which can be sensed by a profoundly deaf and sightless person. For examle signal generator 24 can be merely a group of amplifiers and transducer 26 can be solenoid arranged to cause a hammer to tap the underside of a sensory surface so that these taps can be palpated by a person, e.g. by putting a finger on such surface. The taps can be distinguished by varying their intensity or by combining them with palpable buzzing manifestations of different frequencies. These possibilities are indicated in Table III.

TABLE III

| Indication | Tactile Sensation | | |
|---|---|---|---|
| A | Light Tap | Tap | Buzz $f_1$ |
| B | Medium Tap | Buzz $f_1$ | Buzz $f_2$ |
| C (or A) | Heavy Tap | Buzz $f_2$ | Buzz $f_3$ |

A third possibility is that transducer 26 can be arranged to provide a simple visible output which could be seen by those whose sight is insufficient to recognize numbers. Such a visible output would also be useful where an extremely low cost readout is desired. In this case lamps, preferably light emitting diodes, would be provided and would flash an appropriate number of times in accordance with the numerical readout. The different digits can be distinguished by making the lamps different colors, by using different numbers of lamps (e.g., one lamp to indicate hours, two simultaneously flashing lamps to indicate tens of minutes, and three simultaneously flashing lamps to indicate minutes) or by flashing the lamp at different brightness levels. These possibilities are indicated in Table IV.

TABLE IV

| Indication | Visible (Flashing) Manifestation | | |
|---|---|---|---|
| A | Color 1 | One Lamp | Dim Lamp |
| B | Color 2 | Two Lamps | Medium Lamp |
| C | Color 3 | Three Lamps | Bright Lamp |

In addition to providing different indicia for the respective digits, the same indicia can be provided if a separate indicium is provided for the digit zero. (Otherwise it would not be possible to distinguish between times where the digits differ only by a transposition of a zero, e.g., between 1:02 and 1:20.) In this system, which can briefly be described as a "single tone" system, the digit zero can be indicated, for example, by two short tones so that the time 1:02 would be indicated by the following: long tone, two short tones; two long tones. The time 1:20 would be distinguishable since it would be indicated by the following: long tone; two long tones; two short tones.

In addition to indicating the time by hours and minutes in a twelve-hour system, seconds can also be indicated by providing a fourth tone (or by repeating the second tone) and a twenty-four hour system can be provided.

The manual interrogate control may be connected at the front door of a house so that when a caller pressed the doorbell button the time of day will be read out in electronic tones in lieu of the conventional, simple doorbell sound.

While the audio system is useful in horology as a table clock or watch, it can also be used to indicate other numerical data such as elapsed time (as with a stopwatch), temperature of a darkroom developer, oven temperature (for sightless persons), vehicle speed (where looking at a speedometer would be dangerous), etc.

While a numerical word indicating system has been described, it can also be used to indicate words comprised of other characters, such as letters and symbols, by fashioning appropriate sequential codes for such letters and symbols.

An economical clock version of the system could be provided in which the time would be indicated only on each hour or on each hour and half hour; the manual interrogate control would cause the time at the last hour or half hour (rather than the exact time) to be indicated. While such a system would be able to indicate the time with less accuracy, the following components could be eliminated: multiplexer 22, counter 16, and counter 18; also time counter 12 and delay gate 20 could be simplified.

In a system of this type in which every half-hour is indicated source 10 would supply hourly pulses to time counter 12 which would simply provide a four-digit BCD readout to a single hours counter 14. Thereby a once-per-hour readout would occur automatically even if multiplexer 22 and counters 16 were eliminated. Half-hour indications would be provided by connecting the hourly pulses from source 10 (which have a 50 percent duty cycle) to delay gate 20. In this simplified system delay gate 20 could consist of two monostable multivibrators in tandem, the first of which is triggered when the logical "1" half of the hourly pulses from source 10 and AND-ed with the "zero count" output of hours counter 14. The second monostable multivibrator would be triggered by the first at the end of the first's pulse. When the first monostable multivibrator is triggered, it would produce a pulse of width, say, 3 seconds. At the end of this pulse, the second monostable multivibrator would be triggered to produce a short, single output pulse. This pulse and the countdown clock pulses which are applied to hours counter 14 would be applied to the input of an OR gate. The output of this gate would in turn be applied to signal generator 24. At the half hour, the signal generator would be activated in the aforementioned manner to count out the hour. At the end of this count, the "zero count" output of counter 14 would activate the first monostable multivibrator. A delay (3 seconds) would ensue and then the second monostable multivibrator would be triggered and would emit one short pulse. This pulse would cause the signal generator to emit one count. At the hour, the signal generator would be activated in the aforementioned manner to count out the hour. However, because of the absence of a logical "1" at the hourly pulse input of the AND gate, the first monostable multivibrator (and hence also the second) would not be activated. Hence no single delayed output count (indicative of the half-hour) would be produced.

While the above description contains many specificities, these should not be construed to limit the scope of the invention, but rather to exemplify the preferred and several other embodiments thereof. The true scope of the invention should be determined only by the appended claims and their legal equivalents.

I claim:

1. A multiple-character-word indication system comprising:

(a) means for generating, at respectively different times, a plurality of electrical signals representative of a respective plurality of multiple-character words, (b) means responsive to said electrical signals for indicating each multiple-character word by a sequence of groups of character-representative indicia, each of said groups of indicia representing a respective character of said word and comprising a sequential series of indicia, each indicium being sensible by a human observer, each indicium being identical with the other indicia of its group and having insufficient information content to unambiguously indicate the identity of every character representable by said group, the indicia of each group aggregatively having sufficient information content to indicate the identity of the character representable by said group.

2. The system of claim 1 wherein the individual indicia of sequentially adjacent groups are different in a humanly-sensible manner.

3. The system of claim 2 wherein said multiple-character words represent sequential elapsed times from a base time, whereby said system is a clock.

4. The system of claim 3 whrein the number of indicia in each of said groups is identical to the respective digit, of the elapsed time, indicated by said group.

5. The system of claim 1 wherein said indicia are audible.

6. The system of claim 1 wherein said audible indicia provide tones of different pitches.

7. The system of claim 1 wherein said indicia are tactile.

8. The system of claim 1 wherein said indicia are visible.

9. The system of claim 1 further including means for spacing the groups of character-representative indicia a greater amount than adjacent indicia of a single group are spaced.

10. A multiple-digit word indication system, comprising:

(a) means for generating, at respectively different times, a plurality of first groups of binary electrical signals, each first group representative of a multiple-digit word, and (b) means, responsive to each first group of binary signals, for generating a series of second groups of electrical signals, each second group representing a respective digit of the word represented by its corresponding first group and containing a series of identical signals which correspond in number to said respective digit.

11. The system of claim 10 wherein said means for generating a series of second groups of electrical signals includes:

(a) a plurality of presettable counters representing the respective digit positions of said words and connected to receive said binary electrical signals, each of said counters being arranged to provide a predetermined output upon receipt of a number of pulses equal to the count set therein, (b) means for setting said counters in accordance with the respective digits of the multiple digit word represented by a selected one of said first groups of binary electrical signals, and for sequentially activating said counters to count pulses, (c) means for supplying pulses to all of said counters in parallel, (d) means, responsive to the outputs of said counters, for providing said series of second groups of electrical signals, each group containing a number of signals representative of the count set in a respective counter.

12. The system of claim 11 wherein said means for generating said first groups of binary electrical signals generates such signals representative of the time elapsed from a predetermined time, whereby said system is a clock.

13. The system of claim 11 further including a transducer for generating humanly-sensible indicia in response to said series of second groups of electrical signals.

14. The system of claim 13 wherein said humanly-sensible indicia of sequentially adjacent second groups are different in a humanly-sensible manner.

15. The system of claim 10 wherein said means for generating a series of second groups of electrical signals includes means for providing a predetermined spacing between adjacent signals within a group and a greater spacing between adjacent groups of signals.

16. A time indication system comprising:

(a) means for continuously generating a signal indicative of a time quantity, (b) a countdown counter settable by said signal, said counter being arranged to count pulses down from the count set therein, (c) command means for setting said counter with said signal and for activating said counter to count pulses, (d) means for supplying pulses to be counted by said counter, (e) means for indicating seriatim the pulses counted by said counter.

17. A clock comprising:

(a) counting means for continuously providing an output representative of the hours, tens of minutes, and minutes which have elapsed from a predetermined time, (b) sensible transducer means capable of providing a serial plurality of humanly sensible indicia, (c) command means, coupled to said counting means, for causing, at the time of receipt of a command input, said sensible transducer means to indicate the elapsed hours, tens of minutes, and minutes, represented by the output of said counting means, by means of three sequential groups of indicia, the indicia of each group being identical to each other and occurring seriatim, the number of indicia in each of said three groups, starting with the one first occurring in time, being identical to the number of hours, tens of minutes, and minutes, respectively, represented by the output of said counting means, whereby an observer can determine the time by simply counting the indicia in each of said groups seriatim.

18. The clock of claim 16 wherein the output of said counting means is a voltaic quantity, said sensible transducer is arranged to provide an indicium selected from the class consisting of palpable, audible, and visible indicia, and said command means is an electronic circuit.

19. The clock of claim 16 wherein the time interval between adjacent indicia in each of said groups is shorter than the time interval between adjacent groups of indicia.

20. The clock of claim 16 wherein the indicia of adjacent groups are different.

21. The clock of claim 16 further including means for periodically causing said command means to provide said command input to said command means.

* * * * *